US007505716B2

(12) United States Patent
Park

(10) Patent No.: US 7,505,716 B2
(45) Date of Patent: Mar. 17, 2009

(54) PROCESS CARTRIDGE HAVING LOCKABLE PARTS, FOR AN IMAGE FORMING APPARATUS

(75) Inventor: Jong-hyun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 258 days.

(21) Appl. No.: 11/371,075

(22) Filed: Mar. 9, 2006

(65) Prior Publication Data

US 2006/0291909 A1 Dec. 28, 2006

(30) Foreign Application Priority Data

Jun. 24, 2005 (KR) ..... 10-2005-0055059

(51) Int. Cl.
*G03G 15/08* (2006.01)

(52) U.S. Cl. ..... 399/258; 399/106; 399/113; 399/119

(58) Field of Classification Search ..... 399/106, 399/113, 119, 258, 262
See application file for complete search history.

(56) References Cited

U.S. PATENT DOCUMENTS 5,708,925 A 1/1998 Kobayashi et al.
6,968,147 B2 11/2005 Matsuda et al.
2002/0085857 A1* 7/2002 Kim et al. ..... 399/262

FOREIGN PATENT DOCUMENTS

JP 5-333694 12/1993
JP 8-234552 9/1996
JP 2003-122099 4/2003
JP 2004-126018 4/2004

OTHER PUBLICATIONS

Office Action issued In Korean Patent Application No. 2005-55059 on Jul. 21, 2006.

* cited by examiner

*Primary Examiner*—David M Gray
*Assistant Examiner*—Ruth N Labombard
(74) *Attorney, Agent, or Firm*—Stein, McEwen & Bui, LLP

(57) ABSTRACT

A process cartridge of an image forming apparatus including a development cartridge including, a development cartridge housing with a toner inlet port therein, and a toner inlet port cover movably formed at the development cartridge housing, to open and close the toner inlet port, having a rib at a leading end thereof and a locking recess at a lateral surface thereof; and a toner cartridge including, a toner cartridge housing, detachably engaged with the development cartridge, having toner provided therein, a toner supply part provided with a toner supply port and a locking protrusion to contact the rib of the toner inlet port cover, and a locker to lock in the locking recess of the toner inlet port cover. As the toner cartridge is engaged with the development cartridge, the locking protrusion contacts the rib and the locker is locked in the locking recess.

20 Claims, 10 Drawing Sheets

PROCESS CARTRIDGE HAVING LOCKABLE PARTS, FOR AN IMAGE FORMING APPARATUS

CROSS-REFERENCE TO RELATED APPLICATIONS

This application claims the benefit of Korean Application No. 2005-55059, filed Jun. 24, 2005, in the Korean Intellectual Property Office, the disclosure of which is incorporated herein by reference.

BACKGROUND OF THE INVENTION

1. Field of the Invention

An aspect of the present invention relates to an image forming apparatus according to an electrophotography process. More particularly, an aspect of the present invention relates to a process cartridge of the image forming apparatus.

2. Description of the Related Art

A conventional image forming apparatus such as a copier, a printer, a facsimile, and a word processor, which uses an electrophotography process, generally employs a process cartridge. If the process cartridge is applied, a user may efficiently repair the apparatus without needing a skilled repairman. As such, the usefulness of the apparatus may be much improved. Accordingly, these image forming apparatuses have come into wide use.

The process cartridge comprises a development cartridge, and a toner cartridge detachably attached to the development cartridge to supply toner. The development cartridge has a toner inlet port and a toner inlet port cover, and the toner cartridge has a toner supply part with a toner supply port. The toner inlet port of the development cartridge should be opened and closed as the toner cartridge is engaged with and disengaged from the development cartridge. To this end, the toner inlet port cover of the process cartridge slidingly opens and closes the toner inlet port in association with the engagement and disengagement of the toner cartridge with respect to the development cartridge.

FIGS. 1A through 1D are views to explain the structure of opening and closing of toner inlet port of a general process cartridge. Reference numeral 1 designates a development cartridge housing, and has a toner inlet port 1*a*. A toner inlet port cover 2 is movably formed at the development cartridge housing 1 to open and close the toner inlet port 1*a*. A toner cartridge 3 has a lever 4 elastically biased downward by a toner supply port 3*a*, a locking protrusion 3*b*, and a spring 4*a*. The development cartridge housing 1 also has a guide protrusion 1*b*.

As the toner cartridge 3 is slid in the development cartridge during an engagement process, the locking protrusion 3*b* of the toner cartridge 3 comes into contact with a leading end of the toner inlet port cover 2 (see FIG. 1B) so that the toner inlet port cover 2 moves in the direction toward the right side of the FIGs. and the toner inlet port 1*a* of the development cartridge is opened.

FIG. 1C is a view of the toner cartridge 3 completely mounted to the development cartridge. As shown, the toner supply port 3*a* of the toner cartridge 3 is aligned with the toner supply port 1*a* of the development cartridge so that toner may be supplied therethrough, and the lever 4 of the toner cartridge 3 is inserted in a recess 2*a* of the toner inlet port cover 2.

Here, as the toner cartridge 3 is pulled out during a disengagement operation, the toner inlet port cover 2 moves in the direction toward the left side of the FIGs. as a result of the lever 4 being withdrawn from the recess 2*a* so that the toner inlet port 1*a* may be closed. The lever 4 is lifted by the guide protrusion 1*b* (see FIG. 1C) of the development cartridge out of the recess 2*a* of the toner inlet port cover 2 just before completely closing the toner inlet port 1*a* so that the toner cartridge 3 may be disengaged.

FIG. 1D is an enlarged view of a structure of the toner inlet port cover 2 slidingly engaged with the development cartridge housing 1. As shown, the development cartridge housing 1 has a recess part 11 and the toner inlet port cover 2 has a protrusion part 21 inserted in the recess part 11 so that the toner inlet port cover 2 can move laterally, without separating vertically.

However, sealing the general process cartridge with the above structure is difficult. In other words, as the toner cartridge is engaged with the development cartridge, the toner inlet port 1*a* of the development cartridge should be aligned with the toner supply port 3*a* of the toner cartridge 3, and there should be no gap between the toner inlet port 1*a* and the toner supply port 3*a*. If there is a gap, toner particles with sizes less than 10 μm leak out as supplied. To prevent this, a sponge seal should be attached between the toner cartridge and the development cartridge. However, the sponge seal interferes with the smooth movement of the toner inlet port cover 2 and operations of the lever 4. Thus, the above structure may not be compatible with the sponge seal and an image density may be deteriorated due to the toner leakage.

Additionally, the conventional process cartridge has a structure that slidingly moves the toner inlet port cover 2 by using the lever 4 elastically biased by the spring 4*a*. Accordingly, the lever 4 may not be inserted in or not be separated from the recess 2*a* of the toner inlet port cover 2 so that the toner inlet port cover 2 may not smoothly move and the lever 2 may be occasionally damaged.

SUMMARY OF THE INVENTION

Aspects of the present invention have been conceived to solve the above-mentioned and/or other problems occurring in the prior art, and aspects of the present invention provide a process cartridge of an image forming apparatus which employs a seal member to prevent a leakage of toner.

Another aspect of the present invention provides a process cartridge of an image forming apparatus with a closing and opening unit of a toner inlet port which has a simple structure and which obtains an operational reliability in the closing and opening of the toner inlet port.

In order to achieve the above and/or other aspects, there is provided a process cartridge of an image forming apparatus comprising, a development cartridge including, a development cartridge housing with a toner inlet port therein, and a toner inlet port cover movably formed at the development cartridge housing, to open and close the toner inlet port, having a rib at a leading end thereof and a locking recess at a lateral surface thereof; and a toner cartridge including, a toner cartridge housing, detachably engaged with the development cartridge, having toner provided therein, a toner supply part provided with a toner supply port and a locking protrusion to contact the rib of the toner inlet port cover, and a locker to lock in the locking recess of the toner inlet port cover.

As the toner cartridge is engaged with the development cartridge, the locking protrusion of the toner supply part contacts the rib of the toner inlet port cover to move the toner inlet port cover in an engagement direction of the toner cartridge so as to open the toner inlet port, and as the toner cartridge is disengaged from the development cartridge, the locker is locked in the locking recess of the toner inlet port cover to move the toner inlet port cover in a disengagement direction of the toner cartridge so as to close the toner inlet port.

The process cartridge may further comprise a release member to release the locking of the locker just before the toner inlet port cover completely closes the toner inlet port as the toner cartridge is disengaged from the development cartridge. The locker comprises a hook elastically biased in a locking direction of locking in the locking recess of the toner inlet port; and a release arm to contact the release member to rotate the hook in an opposite direction. The release member may comprise a protrusion rib integrally formed at a side of the development cartridge housing.

The toner inlet port cover comprises first through fourth slide parts, and the development cartridge housing comprises first through fourth guide parts slidingly contacting the first through the fourth slide parts. A seal member may be disposed around the toner inlet port of the development cartridge housing to prevent a leakage of toner.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
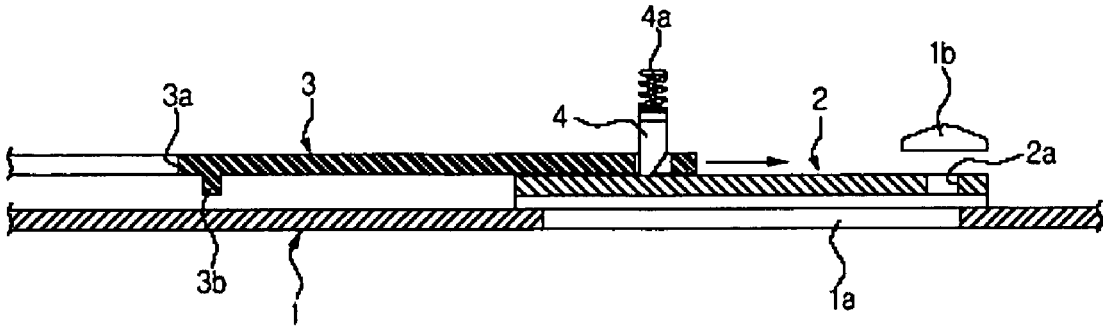
FIG. 1A (PRIOR ART)
FIGS. 1A through 1C are views to explain the structure and operations of opening and closing a toner inlet port of a general process cartridge.
Figure 1B:
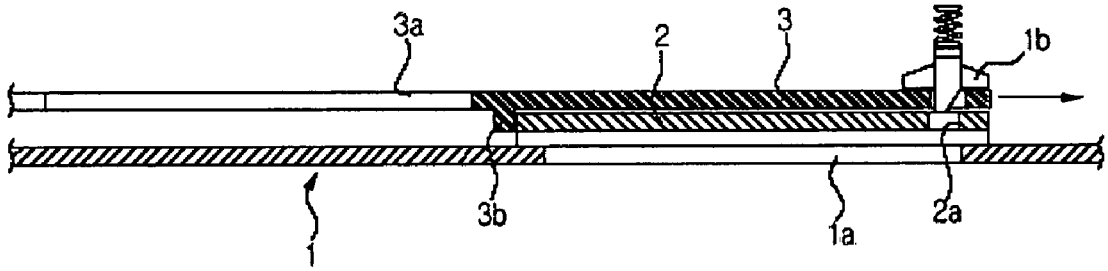
FIG. 1B (PRIOR ART)
Figure 1C:
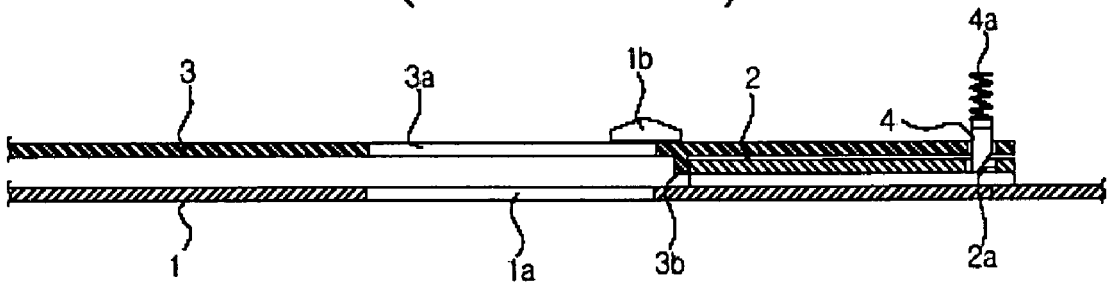
FIG. 1C (PRIOR ART)
Figure 1D:
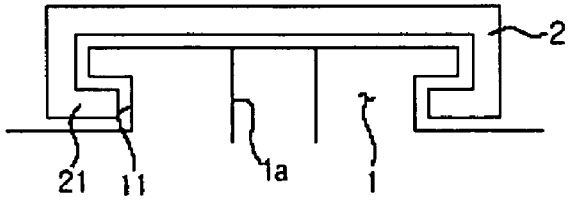
FIG. 1D (PRIOR ART)
FIG. 1D is a view of the structure of a toner inlet port cover engaged with a development cartridge of a general process cartridge.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
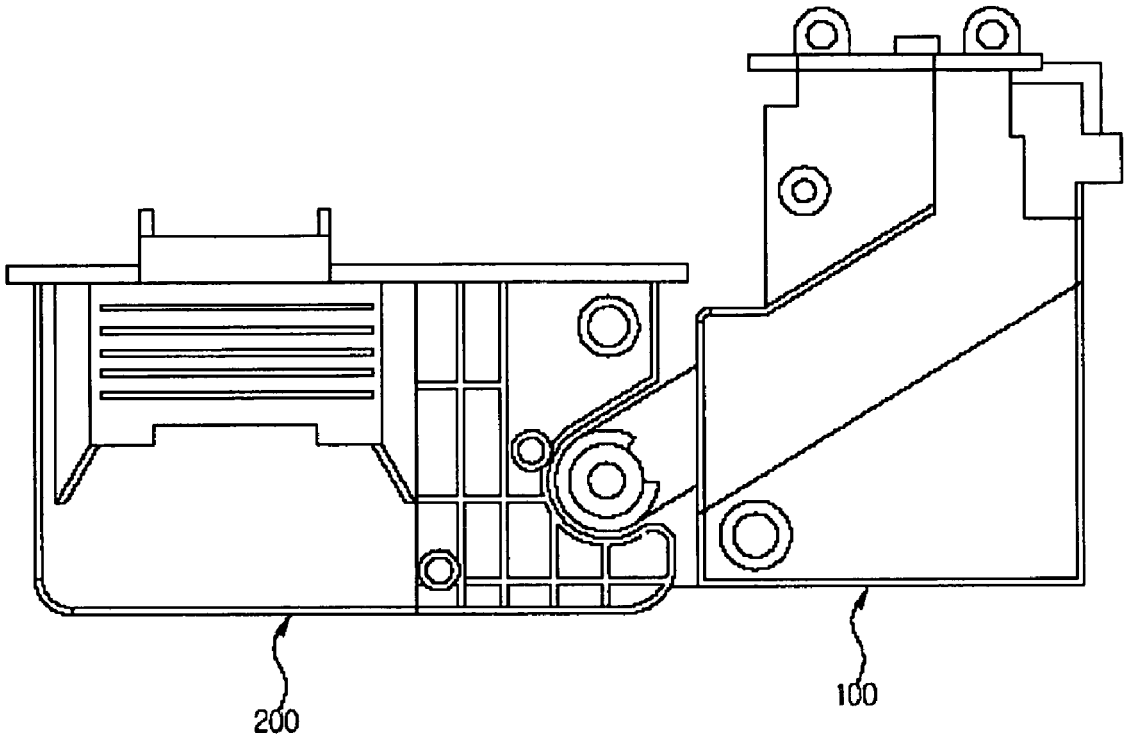
FIG. 2 is a view of the engagement with a toner cartridge and a development cartridge of a process cartridge according to an embodiment of the present invention.

Referring to FIG. 2, a process cartridge of an image forming apparatus according to an embodiment of the present invention is illustrated as comprising a development cartridge 100, and a toner cartridge 200 detachably engaged with the development cartridge 100. As is generally well known, the development cartridge 100 is supplied with toner as the toner cartridge 200 is engaged with the development cartridge 100.

Figure 3:
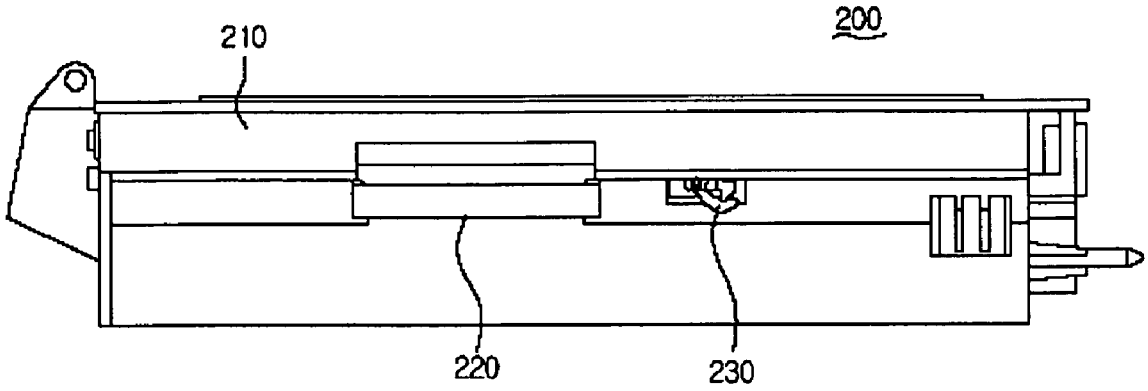
FIG. 3 is a view of a toner cartridge of a process cartridge according to an embodiment of the present invention.
Figure 4A:
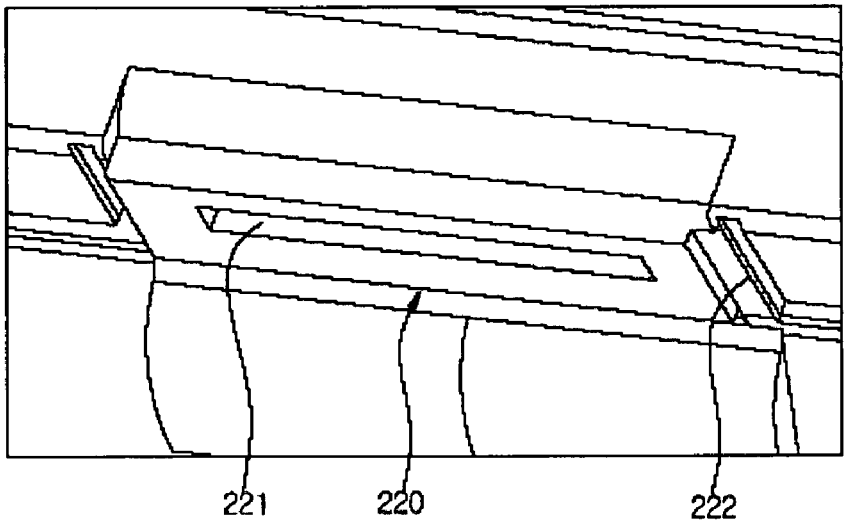
FIGS. 4A and 4B are detailed views of a toner supply part and a locker of the toner cartridge of FIG. 3.
Figure 4B:
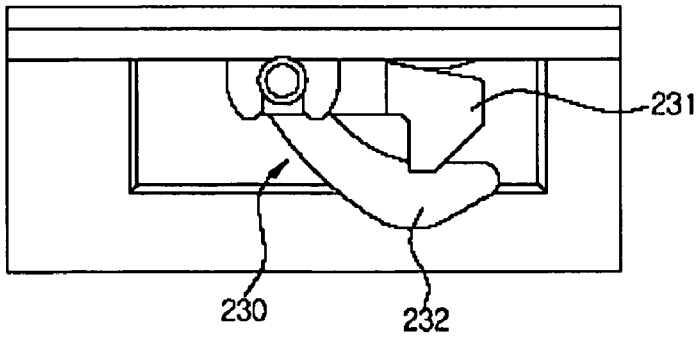

Referring to FIGS. 3, 4A, and 4B, the toner cartridge 200 is illustrated as comprising a toner cartridge housing 210 with toner therein. The toner cartridge housing 210 has a toner supply part 220 with a toner supply port 221. The toner supply part 220 has a locking protrusion 222 at a leading end. The toner cartridge housing 210 has a locker 230, which includes a hook 231 and a release arm 232, and will be explained in detail later.

Figure 5:
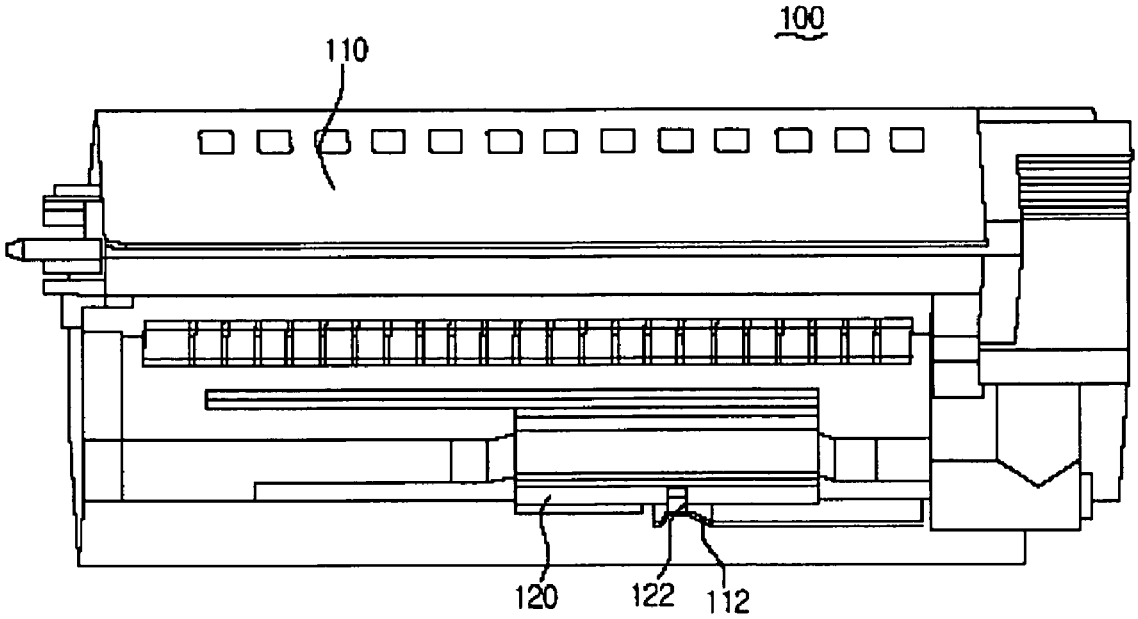
FIG. 5 is a view of a development cartridge of a process cartridge according to an embodiment of the present invention.
Figure 6A:
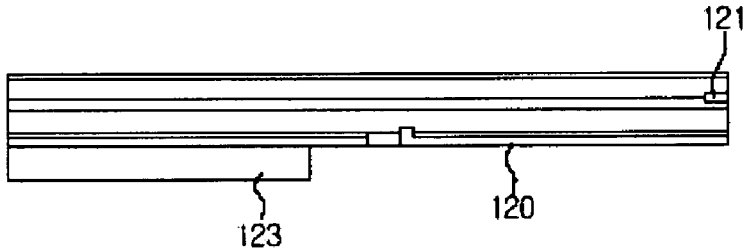
FIGS. 6A through 6C are views for explaining the structure of a toner inlet port cover of the development cartridge of FIG. 5.
Figure 6B:
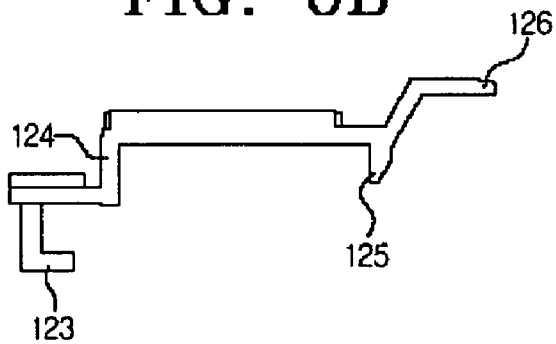
Figure 6C:
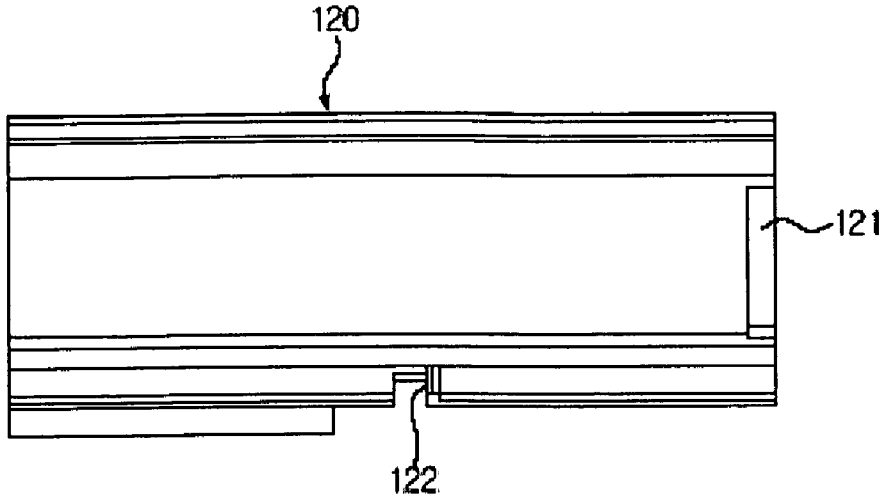
Figure 7:
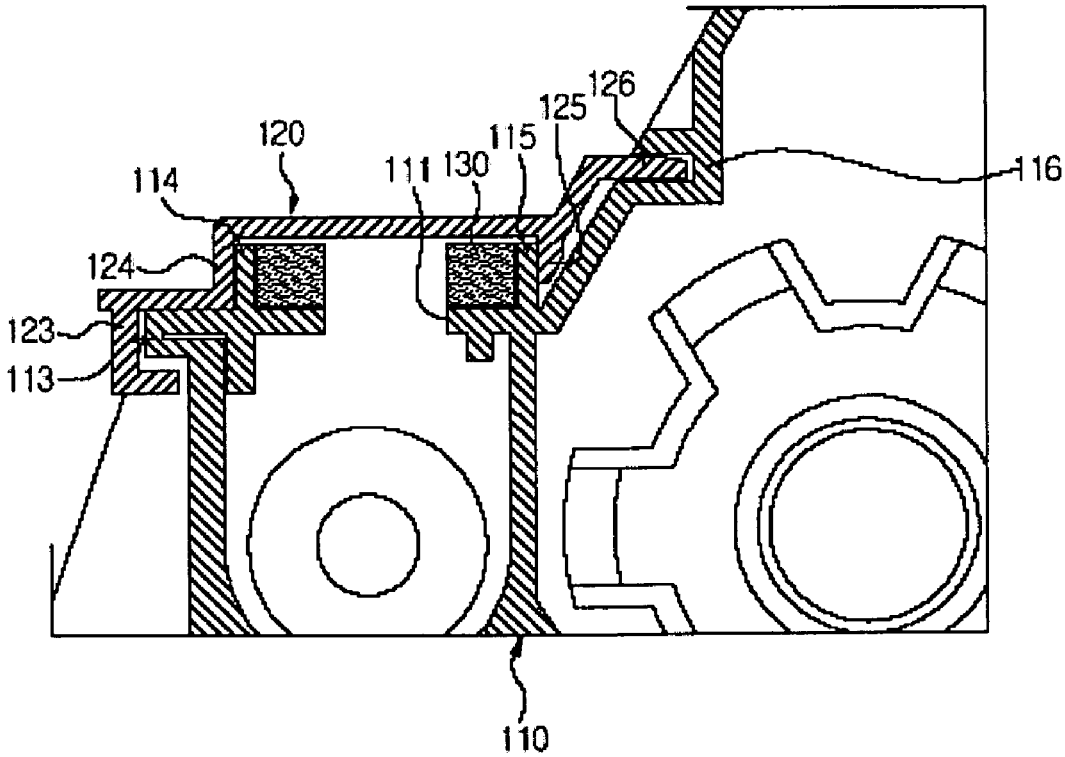
FIG. 7 is a cross sectional view of the toner inlet port cover engaged with the development cartridge.

Referring to FIGS. 5 through 7, the development cartridge 100 is illustrated as comprising a development cartridge housing 110 with a toner inlet port 111, and a toner inlet port cover 120 slidingly formed at the development cartridge housing 110 to open and close the toner inlet port 111.

With reference to FIGS. 6B, 7, 8B and 10A, the toner inlet port cover 120 has a rib 121 at a leading end thereof, which contacts the locking protrusion 222 of the toner supply part 220 of the toner cartridge 200. The toner inlet port cover 120 has a recess 122 at a lateral surface thereof in which the hook 231 of the locker 230 of the toner cartridge 200 is to be caught. The toner inlet port cover 120 comprises first through fourth slide parts 123, 124, 125 and 126. Similarly, the development cartridge housing 110 has first through fourth guide parts 113, 114, 115, and 116 corresponding to the first through the fourth slide parts 123 through 126, as the toner inlet port cover 120 is slid along the development cartridge housing 110.

A seal member 130 is disposed around the toner inlet port 111 to prevent an occurrence of a gap between the toner supply port 221 of the toner cartridge 200 and the toner inlet port 111. The seal member 130 is so disposed so as not to interfere with a movement of the toner inlet port cover 120 as shown in FIG. 7.

The hook 231 of the locker 230 is formed at the toner cartridge 200 to be elastically biased in a hooking direction. As such, the hook 231 is biased to be inserted into the locking recess 122. The release arm 232 is formed to cause the hook 231 to rotate in an unhooking direction.

The development cartridge housing 110 has a protrusion rib 112 to act as an unlocking member, which contacts the release arm 232 to release the hook 231 as the toner cartridge 200 is disengaged from the development cartridge 100.

Processes of assembly and disassembly of the process cartridge of the image forming apparatus according to an embodiment of the present invention will be explained below with reference to FIGS. 8A through 12C.

Figure 8A:
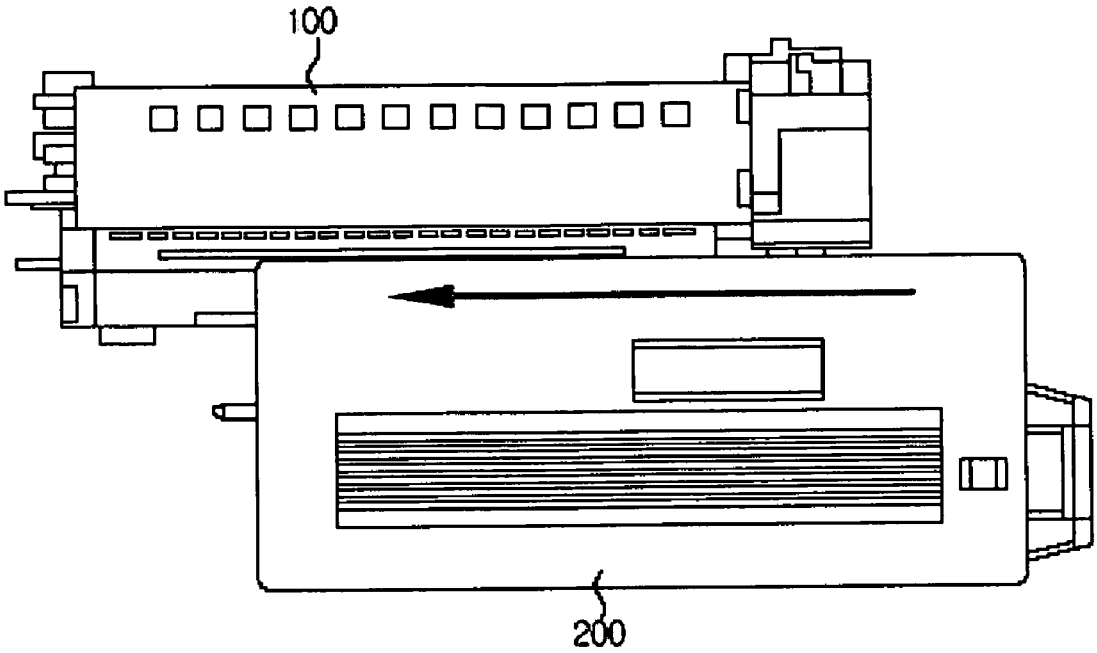
FIG. 8A is a view of an initial status of a toner cartridge engaged with a development cartridge.
Figure 8B:
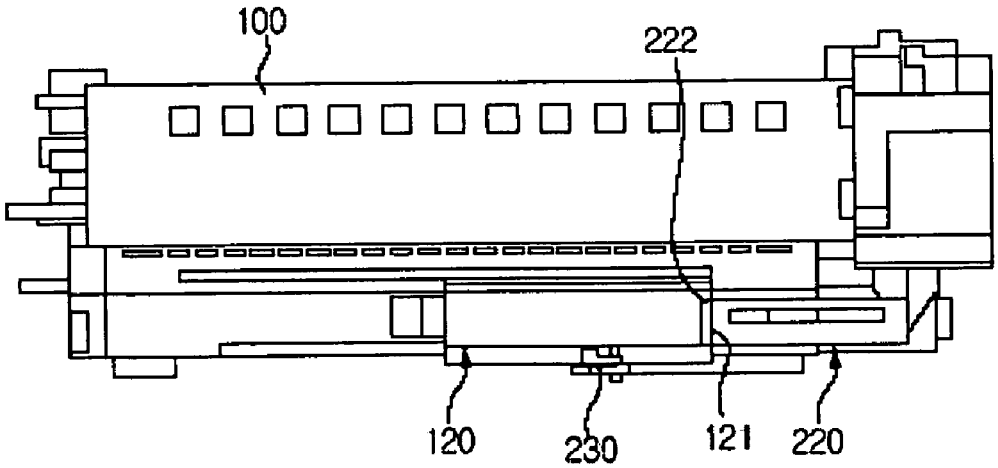
FIG. 8B is a view of the toner cartridge engaged with the development cartridge of FIG. 8A from which a toner cartridge housing is removed.

FIG. 8A shows an initial status of the toner cartridge 200 in the process of being engaged with the development cartridge 100, and FIG. 8B shows a status of the toner cartridge 200 being engaged with the development cartridge 100 at a position from which the toner cartridge housing is removed.

As the toner cartridge 200 slides into position relative to the development cartridge 100 as shown in FIG. 8A, the locking protrusion 222 of the toner supply part 220 of the toner cartridge 200 contacts the rib 121 of the toner inlet port cover 120 of the development cartridge 100 so that the toner inlet port cover 120 moves in an assembly direction (arrow direction of FIG. 8A) along the toner cartridge 200. Once the hook 231 of the locker 230 of the toner cartridge 200 is caught in the locking recess 122 of the toner inlet port cover 120, the toner cartridge 200 is assembled.

Figure 9:
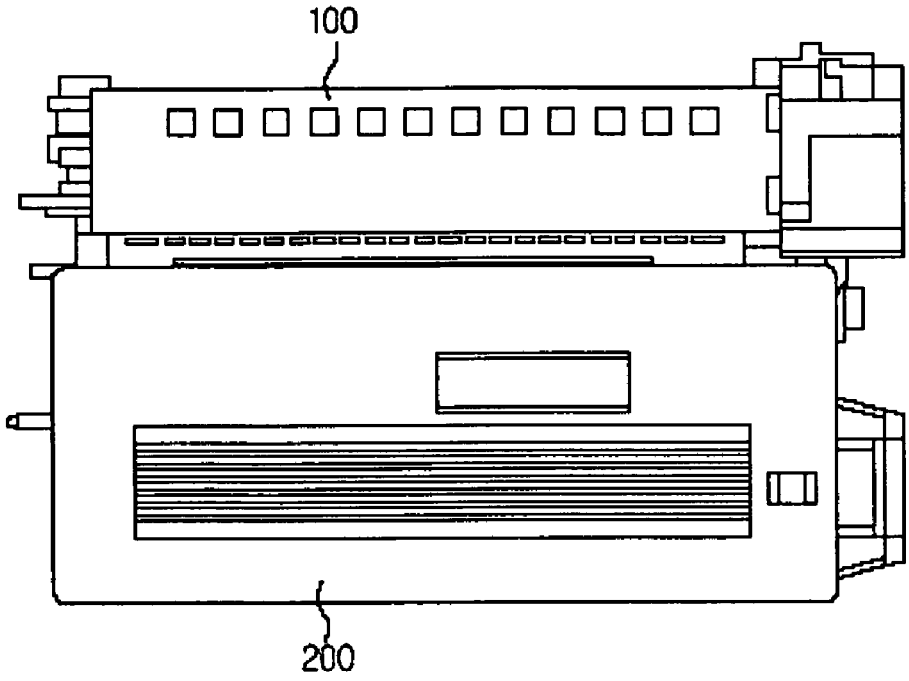
FIG. 9 is a view of a toner cartridge completely engaged with a development cartridge.
Figure 10A:
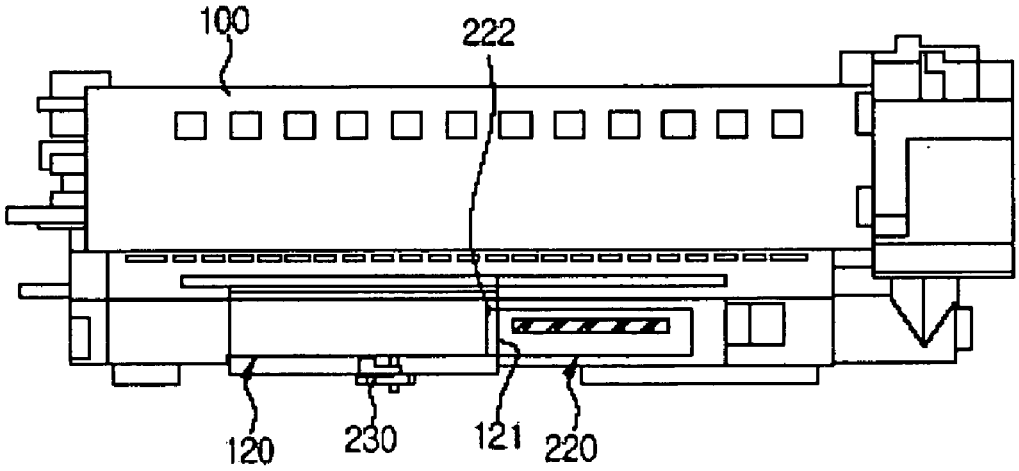
FIG. 10A is a view of the toner cartridge completely engaged with a development cartridge of FIG. 9 from which a toner cartridge housing is removed.
Figure 10B:
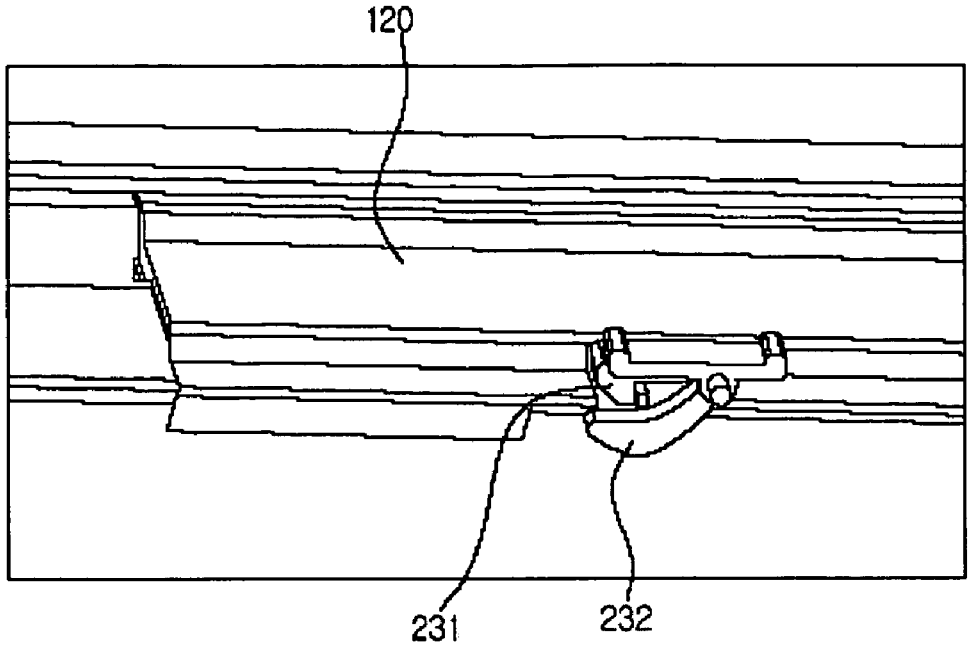
FIG. 10B is an enlarged view of a locker of FIG. 10A.

FIG. 9 shows the toner cartridge 200 having been completely engaged with the development cartridge 100. FIG. 10A illustrates the embodiment shown in FIG. 9 with the representation of the toner cartridge housing removed, and FIG. 10B is an enlarged view of the locker of FIG. 10A. As shown, the toner inlet port cover 120 of the development cartridge 100 fully moves to the left side of FIG. 10A. Therefore, the toner inlet port 111 is opened. The toner inlet port 221 of the toner supply part 220 of the toner cartridge 200 is positioned on the opened toner inlet port 111 so that the toner of the toner cartridge 200 may be supplied to the development cartridge 100. At this time, the seal member 130 is disposed between the toner inlet port 111 and the toner supply port 221 so as to prevent an occurrence of a gap therebetween and to prevent a leakage of toner. Additionally, the hook 231 of the locker 230 is inserted in the locking recess 122 of the toner inlet port cover 120.

Figure 11:
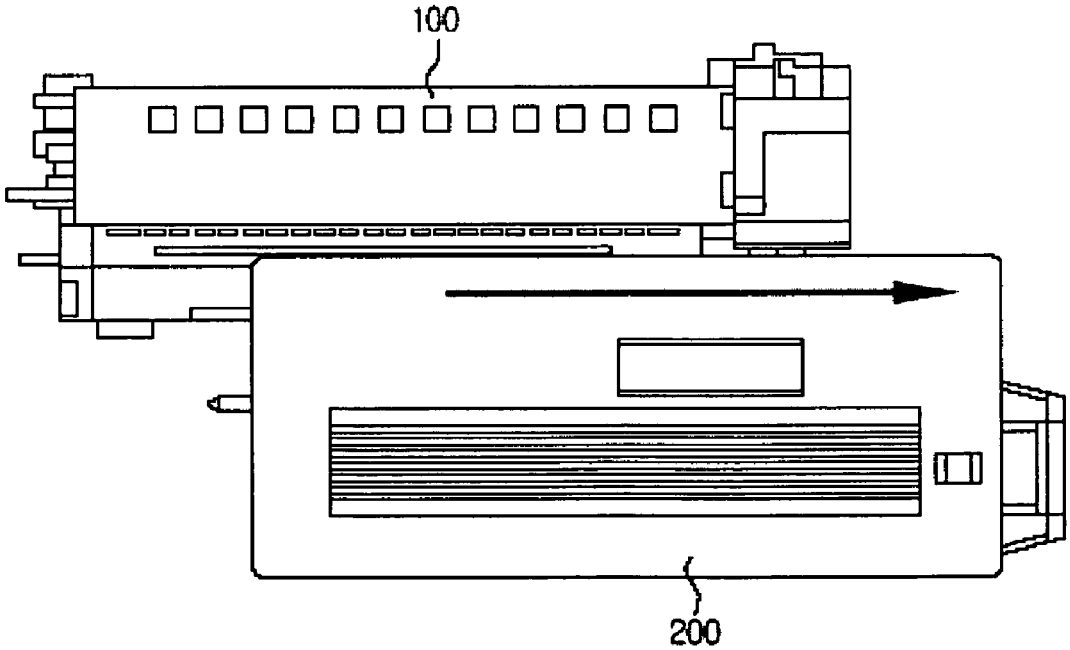
FIG. 11 is a view of an initial status of a toner cartridge disengaged from a development cartridge.

FIG. 11 shows an initial status of the toner cartridge 200 as the toner cartridge 200 is disengaged from the development cartridge 100. As shown, since the hook 231 of the locker 230 of the toner cartridge 200 is caught in the locking recess 122 of the toner inlet port cover 120 of the development cartridge 100, as the toner cartridge 200 is pulled out from the development cartridge 100 in the direction pointed out by the arrow of FIG. 11, moving in a disassembly direction of the toner cartridge 200, i.e., to the right side of FIG. 11, the toner inlet port cover 120 closes the toner inlet port 111 of the development cartridge 100.

Figure 12A:
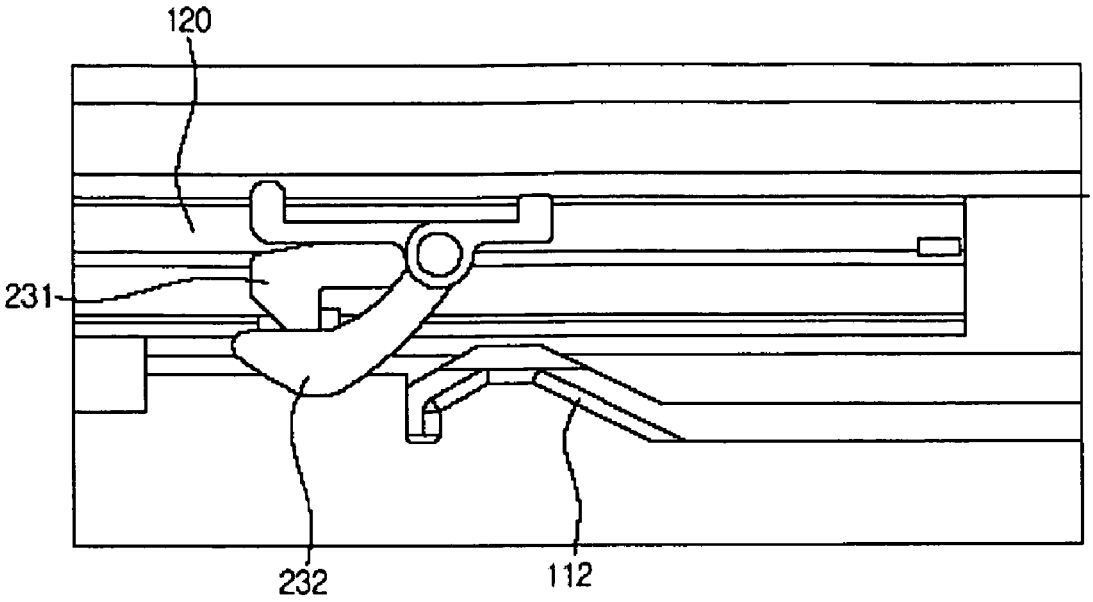
FIGS. 12A through 12C are views for explaining the process of unlocking a locker of a toner cartridge from a development cartridge while a toner cartridge is disengaged from a development cartridge.
Figure 12B:
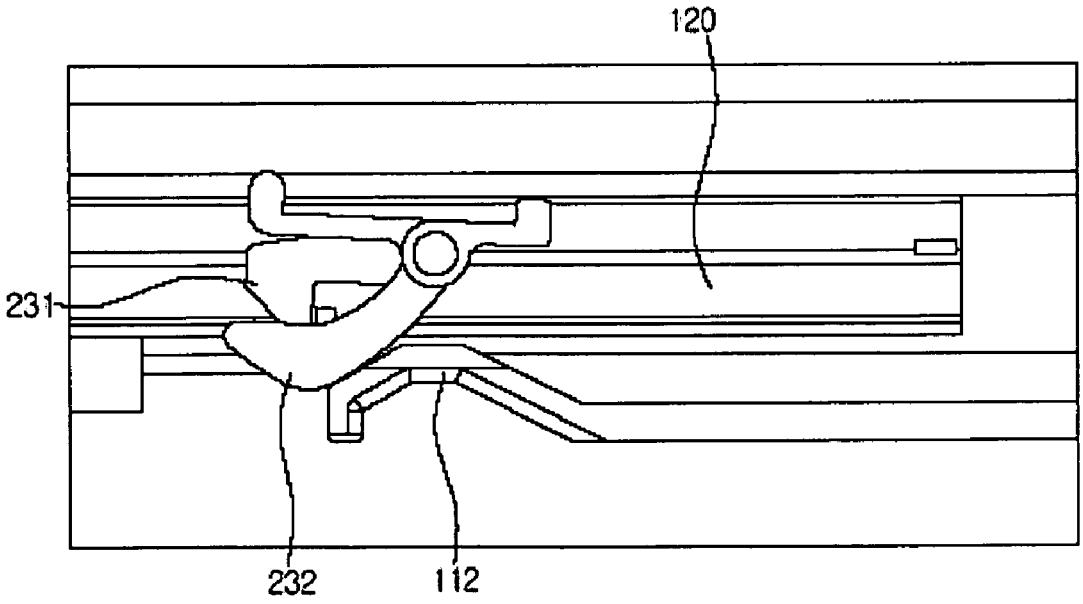
Figure 12C:
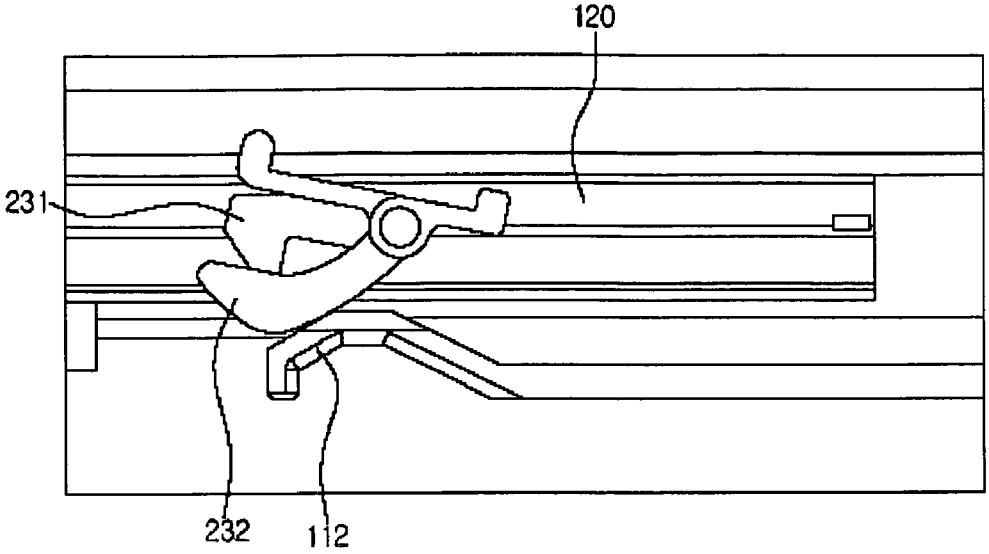

At this time, as a result of contact with the protrusion rib 112 of the development cartridge 100, the release arm 232 of the locker 230 rotates in an unhooking direction, i.e., in a clockwise direction shown in FIGS. 12A through 12C just before the toner inlet port cover 120 completely closes the toner inlet port 111. Rotating together by the rotation of the release arm 232, the hook 231 is removed from the locking recess 122 so that the hooking may be released and the toner cartridge 200 may be smoothly disengaged from the development cartridge 100.

Figure 13:
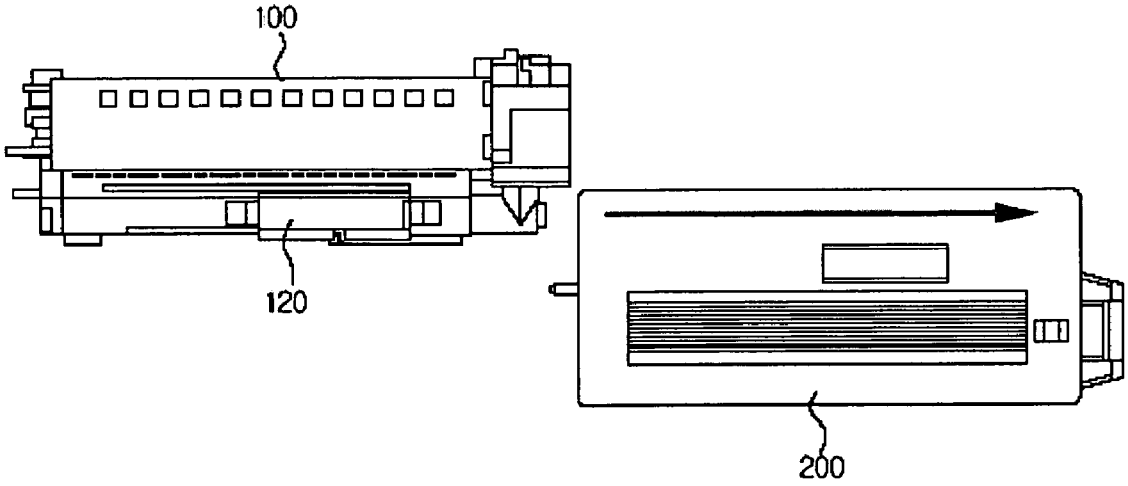
FIG. 13 is a view of a toner cartridge completely disengaged from a development cartridge.

FIG. 13 illustrates the toner cartridge 200 as having been completely disengaged from the development cartridge 100. As shown, the toner inlet port cover 120 of the development cartridge 100 fully moves to the right side of FIG. 13 so that the toner inlet port 111 of the development cartridge 100 is closed.

As is described above, according to the process cartridge of the image forming apparatus consistent with embodiments of the present invention, the toner inlet port cover 120 of the development cartridge 100 smoothly slides to open and close the toner inlet port 111 of the development cartridge 100 as the toner cartridge 200 is engaged with and disengaged from the development cartridge 100. Additionally, there are substantially no gaps formed between the development cartridge 100 and the toner inlet port cover 120, and between the toner inlet port 111 of the development cartridge 100 and the toner supply port 221 of the toner cartridge 200 so as to efficiently prevent the leakage of toner.

According to embodiments of the present invention as described above, toner does not leak as an image is formed so that a deterioration of image quality caused by leakage of toner may be prevented and so that image quality may be maintained.

The process cartridge according to aspects of the image forming apparatus has a simple structure to allow for a closing and an opening of the toner inlet port and requires a relatively small number of features so that the manufacture thereof may be relatively easy and so that manufacturing costs may be decreased.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A process cartridge of an image forming apparatus comprising:

a development cartridge including, a development cartridge housing with a toner inlet port therein, and a toner inlet port cover movably formed at the development cartridge housing, to open and close the toner inlet port, having a rib at a leading end thereof, and a locking recess at a lateral surface thereof; and a toner cartridge including, a toner cartridge housing, detachably engaged with the development cartridge, having toner provided therein, a toner supply part provided with a toner supply port and a locking protrusion to contact the rib of the toner inlet port cover, and a locker to lock in the locking recess of the toner inlet port cover, the locker positioned such that the locker does not move across the toner inlet port, when the toner cartridge is being moved into engagement with the development cartridge.

2. The process cartridge according to claim 1, wherein, as the toner cartridge is engaged with the development cartridge, the locking protrusion of the toner supply part contacts the rib of the toner inlet port cover to move the toner inlet port cover in an engagement direction of the toner cartridge so as to open the toner inlet port.

3. The process cartridge according to claim 2, wherein, as the toner cartridge is disengaged from the development cartridge, the locker is locked in the locking recess of the toner inlet port cover to move the toner inlet port cover in a disengagement direction of the toner cartridge so as to close the toner inlet port.

4. The process cartridge according to claim 3, further comprising a release member to release the locking of the locker just before the toner inlet port cover completely closes the toner inlet port as the toner cartridge is disengaged from the development cartridge.

5. The process cartridge according to claim 4, wherein the toner inlet port cover comprises first through fourth slide parts, and the development cartridge housing comprises first through fourth guide parts to respectively slidingly contact the first through the fourth slide parts.

6. The process cartridge according to claim 5, further comprising a seal member disposed around the toner inlet port of the development cartridge housing to prevent a leakage of toner.

7. The process cartridge according to claim 6, wherein the seal member is separated from the toner inlet port cover.

8. A process cartridge of an image forming apparatus comprising:

a development cartridge comprising, a development cartridge housing with a toner inlet port therein, and a toner inlet port cover movably formed at the development cartridge housing, to open and close the toner inlet port, having a rib at a leading end thereof, and a locking recess at a lateral surface thereof;

a toner cartridge comprising, a toner cartridge housing, detachably engaged with the development cartridge, having toner provided therein, a toner supply part provided with a toner supply port and a locking protrusion to contact the rib of the toner inlet port cover, and a locker to lock in the locking recess of the toner inlet port cover, the locker positioned such that the locker does not move across the toner inlet port, when the toner cartridge is moved into engagement with the development cartridge; and a release member to release the locking of the locker just before the toner inlet port cover completely closes the toner inlet port as the toner cartridge is disengaged from the development cartridge, wherein the locker comprises, a hook elastically biased in a locking direction in the locking recess of the toner inlet port, and a release arm to contact the release member to rotate the hook in an opposite direction.

9. The process cartridge according to claim 8, wherein the release member comprises a protrusion rib integrally formed at a side of the development cartridge housing.

10. A development cartridge to which a toner cartridge with a locking mechanism is to be attached in a process cartridge of an image forming apparatus, the development cartridge comprising:

a development cartridge housing with a toner inlet port therein; and a toner inlet port cover movably formed at the development cartridge housing, to open and close the toner inlet port, having a rib at a leading end thereof and a locking recess at a lateral surface thereof to activate the locking mechanism of the toner cartridge, to open the toner inlet port by locking the toner inlet port cover in an open position when the toner cartridge is attached to the development cartridge, wherein the locking recess is positioned such that the locking mechanism does not move across the toner inlet port, when the toner cartridge is being moved into engagement with, and attached to, the development cartridge, and the locking mechanism is thereby positioned to be activated by the locking recess.

11. The development cartridge according to claim 10, further comprising a seal member disposed around the toner inlet port of the development cartridge housing to prevent a leakage of toner.

12. The development cartridge according to claim 11, wherein the seal member is separated from the toner inlet port cover.

13. A method of assembling a process cartridge of an image forming apparatus, comprising:

sliding a toner cartridge along a surface of a development cartridge so as to generate contact between a locking protrusion extending from a toner supply part of the toner cartridge and a rib located at a leading end of a toner inlet port cover of the development cartridge;

causing the toner inlet port cover to move with the toner cartridge toward an open position where a toner inlet port of the development cartridge is opened; and locking the toner cartridge into the toner inlet port cover and the development cartridge once the toner inlet port cover reaches the open position, so as to maintain the position of the toner inlet port cover, by sliding a locking mechanism of the toner cartridge into a locking recess of the toner inlet port cover, without moving the locker across a toner inlet port of the development cartridge.

14. The method according to claim 13, wherein the locking comprises catching a hook of the locking mechanism in the locking recess of the toner inlet port cover.

15. The method according to claim 13, wherein, when the process cartridge is disassembled, the disassembly of the process cartridge comprises pulling the toner cartridge in a direction opposite that of the sliding of the toner cartridge such that the toner inlet port cover closes the toner inlet port and such that a release arm of the locking mechanism contacts a protrusion rib of the process cartridge, causing a rotation of the release arm and a removal of the hook from the recess.

16. The method according to claim 13, further comprising sealing the toner inlet port, wherein the seal is separated from the toner inlet port cover.

17. A development cartridge to which a toner cartridge with a locking mechanism is to be attached in a process cartridge of an image forming apparatus, the development cartridge comprising:

a development cartridge housing with a toner inlet port therein;

a toner inlet port cover movably formed at the development cartridge housing, to open and close the toner inlet port, having a rib at a leading end thereof, and a locking recess at a lateral surface thereof to activate the locking mechanism of the toner cartridge, to open the toner inlet port by locking the toner inlet port cover in an open position when the toner cartridge is attached to the development cartridge; and a seal member disposed around the toner inlet port of the development cartridge housing to prevent a leakage of toner, the seal member being separated from the toner inlet port cover, wherein the locking recess is positioned such that the locking mechanism does not move across the toner inlet port, when the toner cartridge is being moved into engagement with, and attached to, the development cartridge, and the locking mechanism is thereby positioned to be activated by the locking recess.

18. A toner cartridge to be attached to a development cartridge, in which a toner inlet port cover, having a rib at a leading edge thereof and a locking recess at a lateral surface thereof, covers a toner inlet port, in a process cartridge of an image forming apparatus, the toner cartridge comprising:

a toner cartridge housing to detachably engage with the development cartridge;

a toner supply part, including a toner supply port through which toner is supplied from the toner cartridge housing to the toner inlet port of the development cartridge when the toner inlet port cover opens the toner inlet port and a locking protrusion to contact the rib of the toner inlet port cover so as to cause the toner inlet port cover to open the toner inlet port when the toner cartridge housing detachably engages with the development cartridge, such that the locking protrusion does not move across the toner inlet port; and a locker to lock in the locking recess of the toner inlet port cover when the toner inlet port cover opens the toner inlet port such that the toner inlet port is held open, wherein the locker positioned such that the locker does not cross the toner inlet port, when the toner cartridge is being moved into engagement with, and attached to, the development cartridge.

19. The toner cartridge according to claim 18, further comprising a seal member disposed around the toner inlet port of the development cartridge housing to prevent a leakage of toner.

20. The toner cartridge according to claim 19, wherein the seal member is separated from the toner inlet port cover.

* * * * *